US005556168A

United States Patent [19]

Dinsmoor, III et al.

[11] Patent Number: 5,556,168

[45] Date of Patent: Sep. 17, 1996

[54] WHEELCHAIR BACK SYSTEM

[75] Inventors: John C. Dinsmoor, III, Westminster; Barry Van Everen, Loveland; Michael W. Johnson, Lafayette; Grant C. Denton, Boulder, all of Colo.

[73] Assignee: Jay Medical Ltd., Boulder, Colo.

[21] Appl. No.: 261,529

[22] Filed: Jun. 17, 1994

[51] Int. Cl.[6] ..... A47C 7/42

[52] U.S. Cl. ..... 297/440.2; 297/DIG. 4

[58] Field of Search ..... 297/440.2, DIG. 4, 297/354.12:183.6

[56] References Cited

U.S. PATENT DOCUMENTS

| | | | |
|---|---|---|---|
| 4,564,240 | 1/1986 | Thieme | 297/183.6 |
| 4,746,168 | 3/1988 | Bracesco | 297/440.2 |
| 5,035,467 | 7/1991 | Axelson et al. | 297/440.2 |
| 5,062,677 | 11/1991 | Jay et al. | 297/DIG. 4 |
| 5,127,709 | 7/1992 | Rubinstein et al. | 297/440.2 |

FOREIGN PATENT DOCUMENTS

| | | | |
|---|---|---|---|
| 9214387 | 9/1992 | WIPO | 297/DIG. 4 |

*Primary Examiner*—Peter M. Cuomo
*Assistant Examiner*—Anthony D. Barfield
*Attorney, Agent, or Firm*—Flehr, Hohbach, Test, Albritton & Herbert

[57] ABSTRACT

A wheelchair back assembly suitable for detachable mounting to the back-supporting posts of a wheelchair. The back assembly includes a relatively rigid shell member carrying post-engaging hooks and a plurality of mounting units formed to be mounted on the wheelchair posts. The mounting units are further formed to slidably receive and automatically releasably lock a pair of the post-engaging hooks on the shell member to the posts against unintentional removal of the back assembly from the wheelchair during normal use of the wheelchair. The mounting units are also formed for single-handed automatic unlocking and release of the pair of hooks from the mounting units and posts upon rotation of the shell member forwardly over the wheelchair seat by an amount in excess of any displacement occurring during normal use of the wheelchair.

14 Claims, 15 Drawing Sheets

WHEELCHAIR BACK SYSTEM

The present invention relates to a back system for wheelchairs and, more particularly, to an improved back system that can be conveniently attached and detached from a wheelchair with one hand from in front of the wheelchair, in order to fold up the wheelchair for transportation or storage. It provides for height and tilt adjustability of the back while the user is seated, has rigid contoured lateral support, and lumbar support that may be positioned to fit the specific height required by the wheelchair user. It also preferably includes a textile cover having pockets, pouches, and the like on the rear surface of the back to improve appearance and provide storage for the user.

The back system mounting apparatus is adjustable so as to precisely fit wheelchairs of various widths, and can either be installed as original equipment or retrofitted onto existing wheelchairs to replace older back structures.

BACKGROUND OF THE INVENTION

Many of the problems faced by wheelchair users are related to the positioning and ultimate posture of the seated wheelchair user. Typical problems include progressive spinal deformations such as kyphosis, lordosis, and scoliosis. Poor posture and permanent spinal deformations can cause reduced function and mobility, fatigue, impaired respiration, impaired swallowing, and increased risk of sacreal or coccygeal tissue break down. Thus, it is very important for any wheelchair back system to provide for proper back angle adjustment because different users will each require a slightly different seat to back angle in order to optimize their own function and mobility.

Another important attribute to any back system is that it be convenient to install and remove. Disabled users must frequently remove and install the wheelchair back and wheelchair cushion from the wheelchair in order to collapse the wheelchair for storage or transportation and put it back together for use. This procedure, when performed independently by a user with impaired mobility, is often accomplished from the driver's side seat or passenger's side seat of an automobile. To collapse the wheelchair, the user must first reach out and remove the back. The wheelchair may then be collapsed and placed in the desired location, such as the rear seat of the automobile. To reassemble the wheelchair, the user will typically pull the collapsed chair from the rear seat of the car and unfold the chair at ground level next to the car. Once the frame is unfolded, the user must then reach out and attach the back onto the wheelchair. Both disassembly and assembly are usually accomplished mostly with one hand because the disabled user must maintain support with the other hand, normally by grasping the steering wheel.

The maneuver of reaching out from the car to attach or detach the wheelchair back can be difficult—particularly since most wheelchair users, especially quadriplegics, have impaired upper extremity function and compromised dexterity in their hands and, therefore, may experience great difficulties in manipulating heavy objects in a precise manner. Because of this, the degree of manipulation required of a particular wheelchair component, such as a seat back, will often determine whether or not it can even be used by a disabled individual.

Besides having the back system as simple and easy as possible to attach and detach, it is also beneficial to have it attachable and detachable by a user from toward the front of the wheelchair. This is because a user having just transferred out of the wheelchair, or about to transfer into the wheelchair, will usually be positioned generally in front of the wheelchair. Accordingly, a simplified back mounting mechanism that enables the wheelchair user to swiftly attach or detach the back system to or from the wheelchair, especially from a position in front of the wheelchair, would greatly expand the usability of the back system to the disabled population.

Another problem facing wheelchair back systems has been the variability of each type of commercially available wheelchair. In particular, the vertical upright posts often differ in configuration from one wheelchair to another. The nominal diameter of the posts may vary from ½" to 1¼". The center to center distances of the posts may vary ±½" despite the typical designation by the wheelchair manufacturer that the chair is a nominal width to the nearest inch (i.e.—an 18" wide wheelchair may actually measure 17.6" wide). These vertical posts may also not be parallel and indeed are designed to taper outward from bottom to top. All of these variations along with the metric size requirements offered by foreign wheelchair manufacturers demand either a custom made back system or a custom fit off-the-shelf back system with considerable adjustability through the available size ranges of wheelchairs.

Most of the prior art systems have dealt with the post dimension variability by maintaining a maximum and minimum width capability which inherently results in a loose fit at the narrow end of the width limit. The loose fit may cause the back to shift from side to side or, in some cases, the outer margins of the back system overhang the width of the wheelchair and interfere with armrests and other peripheral features on the wheelchair.

Numerous attempts have been made to replace the conventional wheelchair upholstery sling back with a comfortable, sturdy, adjustable, supportive, pressure relieving, easy to use back system. However, prior art systems have generally failed to provide a suitable degree of adjustability, without loss of seat depth, in conjunction with a system that is easily attached or detached from the wheelchair and that is also capable of back angle adjustment with no loss of seat depth while the user is occupying the back system. Available systems known to date have also failed to incorporate both the capability to adjust the back angle while the user is in the wheelchair and a removably attachable mounting system that does not alter the adjusted back angle each time the back system is removed from the wheelchair. Furthermore, the prior art back systems have generally failed to address the related problems of maintaining pelvic alignment while the back system is adjusted to the optimum seat to back angle. The so-called "bi angular" back system that is basically two planar support surfaces hinged together at approximately a level equal to the top of the user's pelvis (posterior superior iliac crests) has successfully demonstrated the value of stable pelvic recline.

Another practical problem with existing wheelchairs and wheelchair back systems is the lack of convenient storage capacity provided. Because of this, users are often required to strap make-shift storage apparatus, such as back packs, onto the wheelchair. Such apparatus can be bulky, unsightly, and difficult to keep properly secured in position.

One back system that has successfully addressed some of the above problems is U.S. Pat. No. 5,062,677 to Jay et al., known commercially as the Jay Back or Jay Active Back (assigned to Jay Medical, Ltd., the assignee of the present invention). This system provides height adjustability, tilt adjustability, and lumbar and lateral support adjustability. It also discloses several means by which the back system may be removably attached to the wheelchair. However, the back system of U.S. Pat. No. 5,062,677 requires the user to first disengage a pair of flexible latches or to release a pair of safety latches prior to removing the back system from the wheelchair. Also, the tilt adjustments or angulation of the back are accomplished through the use of wedge shims placed between the rigid support shell and the contoured foam support. This presents two problems. First, the adjustments must be done while the user is out of the wheelchair; and, second, the shims cause the overall support plain of the back system to be displaced forward, thus using up critical seat depth of the fixed length wheelchair. This second problem is important because the basic alignment of the user's center of gravity should not moved too far forward or backwards from the preferred position with respect to the rear axle of the wheelchair.

Another back system is disclosed in U.S. Pat. No. 4,898,425 to Mundy et al. In this back system, the wheelchair back is attached by a pair of fixed upper pins and spring-loaded lower pins that mount into a slotted plate fixed to the vertical posts of a wheelchair. The system described in the Mundy et al. patent requires the user to release and hold the pair of spring loaded lower pins while the user is removing the back, although subsequent modifications to the system now enable the user to release and lock the lower pins in an opened or closed condition and then remove the back from the wheelchair. Angulation of the Mundy et al. back system is accomplished by engaging the upper and lower mounting pins in a variety of slots or holes within the post mounted plates.

Other commercially available wheelchair back systems, such as the Roho Adjust-a-Back, also require the user to pre-release an upper or lower latching mechanism prior to detaching the back from the wheelchair. Angulation is accomplished by adjustment of fixed length linkage arms which connect the basic back structure with the upper and lower mounting hardware attachment points located on the vertical wheelchair posts.

Accordingly, it is an object of the present invention to provide a back system that allows for convenient, single handed attachment or detachment of the back to and from the wheelchair without pre-release or actuation of latches or safety hooks.

Another object of the invention is to provide a back mounting system that self locks, but unlocks easily with a simple positive action by the user to release the back system from the wheelchair.

A related object of the invention is to provide a back system where removal of the back may only occur when the user has exited the back seating system.

Another related object is to provide a back system that is released from its mountings by a simple forward rotational motion through a prescribed angle in conjunction with a pulling action.

Yet another object of the present invention is to provide a wheelchair back system that allows for accurate tilt and height adjustment while the user is seated in the back system.

A related object is to provide a back system that maintains the correct adjustments when it is removed and reinstalled onto the wheelchair.

A further object is to provide a wheelchair back system that can be securely mounted onto a range of wheelchairs having varying post sizes and spacing.

Still another object of the invention is to provide a seat back system with a securely attached and aesthetically pleasing storage apparatus.

BRIEF DESCRIPTION OF THE PRESENT INVENTION

These objects, as well as others that will become apparent upon reference to the accompanying drawings and following detailed description, are provided by an improved wheelchair back system that preferably includes a rigid shell, upper and lower hook units adjustably attached to the rigid shell, a pair of mounting units adjustably attachable to vertical wheelchair posts, and a textile cover with storage pockets attached to the rear surface of the rigid shell.

The rigid shell is preferably contoured and supports a precontoured soft foam back cushion and can have optional lateral supports and/or head rests securely mounted thereon. The rigid shell also has a hand grip cut-out in order to facilitate removal and installation of the back with one hand.

The upper and lower hook units are both preferably adjustable horizontally so as to fit wheelchair posts of varying sizes and widths. This greatly facilitates retrofitting the back system onto existing wheelchairs. Also, both hook units preferably allow for about 15–25 degrees of free up and down rotation (i.e., about a horizontal axis parallel to the plane between the vertical wheelchair posts), so that they will automatically rotate to maintain a flush fit against the wheelchair posts when the seat angulation is changed.

Further, the mounting apparatus for the upper hook units preferably includes a screw adjustment for moving the hooks forward or backward in relation to the rigid shell so as to provide an accurate and continuous angulation adjustment for the seat back. The adjustment drive screws are preferably accessible from behind the wheelchair so that the angulation adjustment can be performed while the user is in the wheelchair. Also, changes in back angulation effected by adjusting the upper hook units do not change the seat positioning of the user forward and backward, as happens with the shim-type angulation adjustment method.

The basic function of the back system mounting units is to removably attach the back system to the wheelchair. The mounting units are preferably secured to the wheelchair posts by band clamps, which allows for full adjustability vertically along the wheelchair posts. Also, the band clamps can be loosened and tightened from the back side of the wheelchair, thereby allowing adjustments to be made while the user is in the wheelchair. The mounting units preferably each include a spring biased pawl arm and retaining arm, between which the lower hooks attached to the rigid shell slide and are secured in place. To install the wheelchair back, a user simply slides the lower hooks down along the wheelchair posts and into the mounting units, which can be done easily with one hand because no other actuation or manipulation of the mounting units is required. When the lower hooks are slid down into the proper position, the mounting units automatically latch them securely into place.

Further, the base of the pawl arm and retaining arm are movably mounted in conjunction with a cam inside the housing of the mounting unit such that when the pawl arm and retaining arm are rotated a certain distance out from the mounting unit, they automatically separate. This separation frees the lower hook units and allows the back to be lifted out. Thus, to detach the back from the wheelchair a user simply pulls the top of the rigid shell forward so as to rotate the pawl arm and retaining arm forward until they separate, and then lifts the back up and out. This procedure can be accomplished easily with one hand from a wide range of positions, most easily from the side and toward the front of the wheelchair.

The simplicity with which the back system of the present invention can be removed and attached from a wheelchair make it ideal for many wheelchair users.

Also, the contoured cushion preferably used with the back system of the present invention is tapered backwards at its lower portion, beginning approximately at the level of the pivot axis about which the seat back reclines. This prevents the lower portion from reducing the seat depth, and thus interfering with the user's position, when the seat back is reclined.

In an additional aspect of the invention, a textile cover is removably affixed to the back surface of the rigid shell to improve the appearance of the back system and also to conceal various accessory mounting hardware. Also, this back cover preferably includes storage compartments consisting of, for example, a series of permanent or detachable textile pouches integral to the textile shell cover.

DESCRIPTION OF THE DRAWINGS

In describing the preferred embodiment, reference is made to the accompanying drawings, wherein.

DETAILED DESCRIPTION OF THE PREFERRED EMBODIMENT

Figure 1:
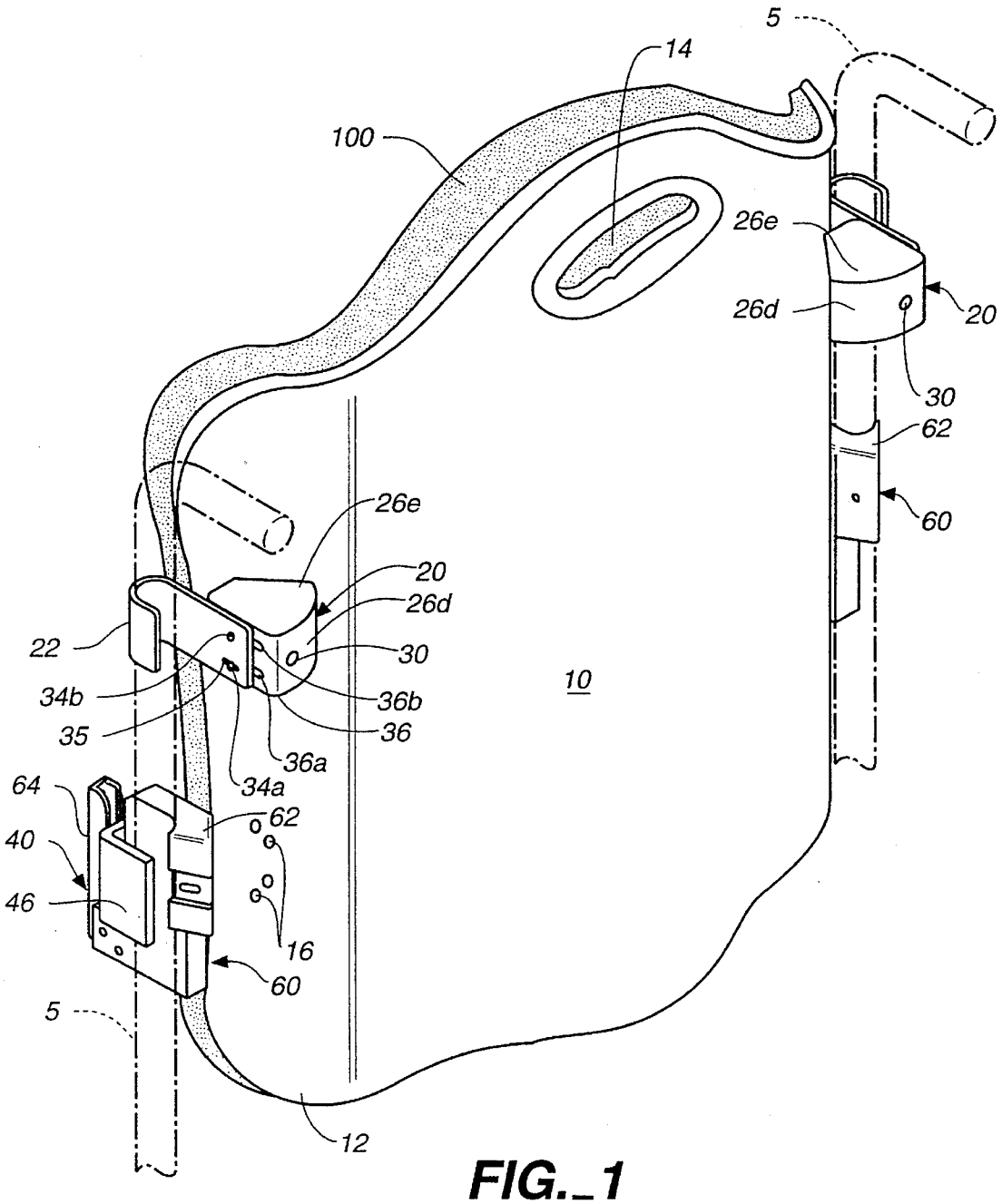
FIG. 1 is a rear isometric view of the back system of the present invention mounted in place against a pair of wheelchair posts.
Figure 2:
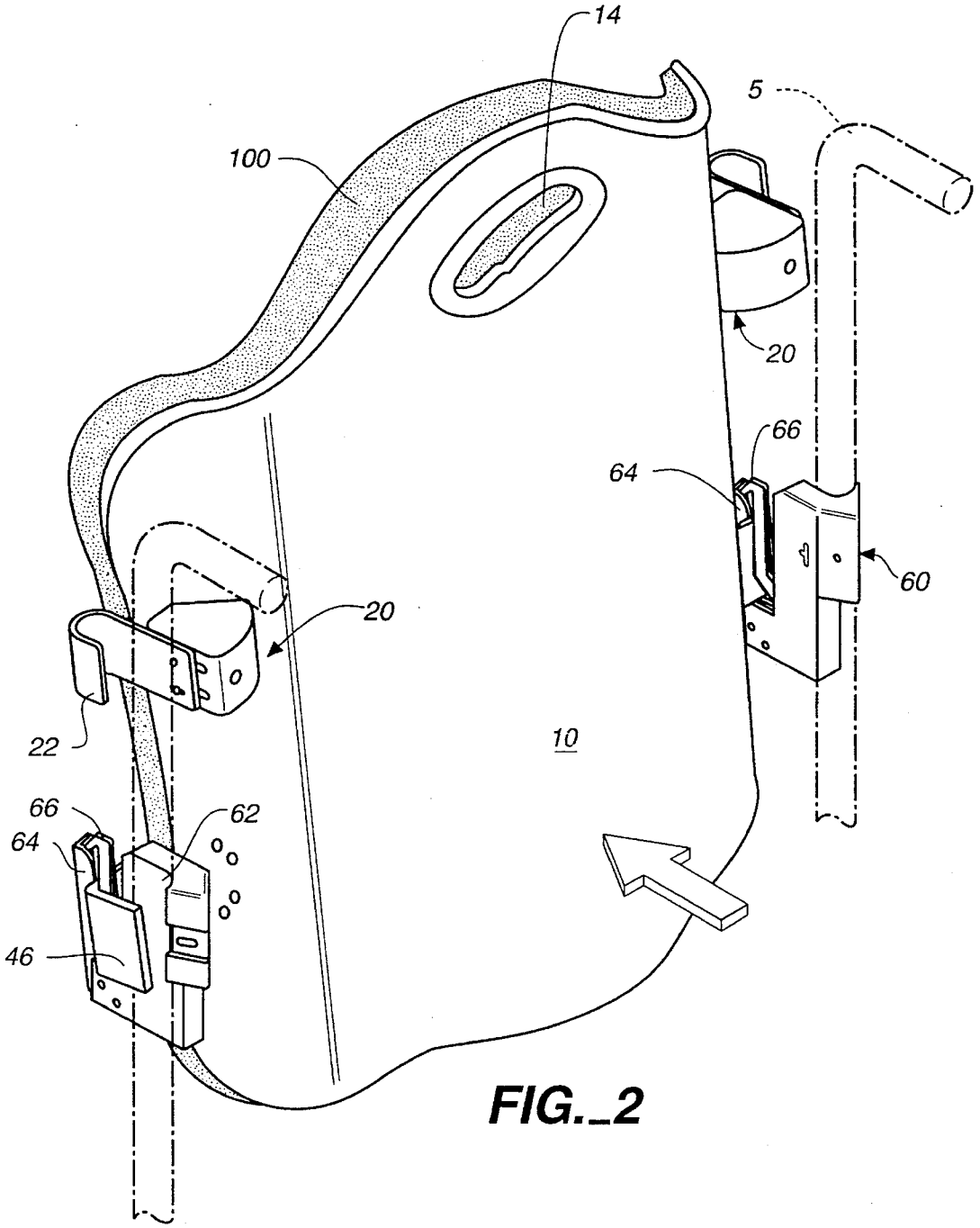
FIG. 2 is a rear isometric view of the back system of the present invention with the back rotated partially forward to begin detaching the back from the wheelchair posts.
Figure 3:
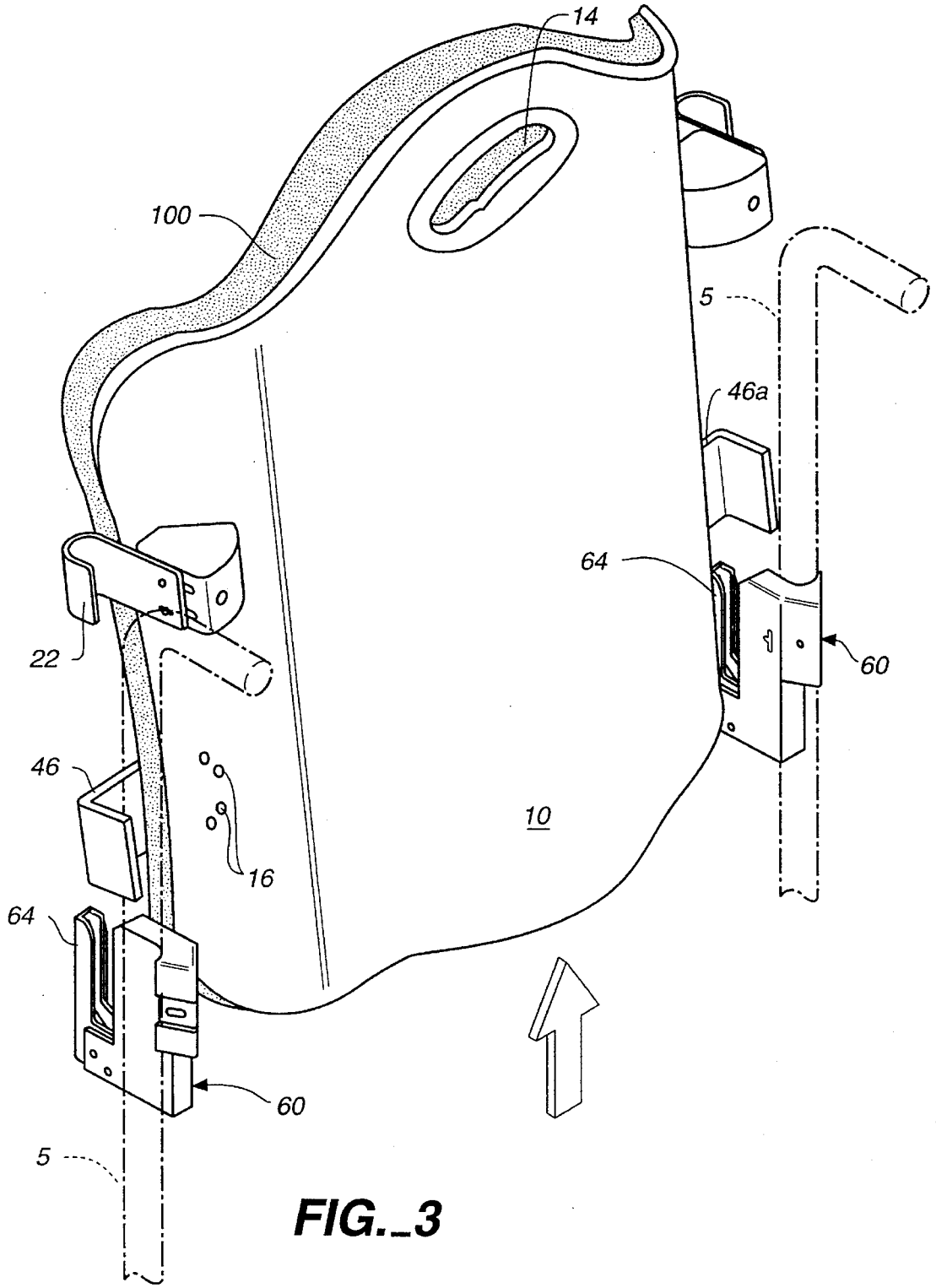
FIG. 3 is a rear isometric view of the back system of the present invention rotated sufficiently forward to detach and lift the back from the wheelchair posts.

The wheelchair back system of the preferred embodiment of the present invention generally comprises a substantially rigid shell 10, a pair of upper hook units 20, a pair of lower hook units 40, and a pair of mounting units 60 which are used to affix the rigid shell and corresponding lower hook units to the vertical posts 5 of a wheelchair, as best seen in FIGS. 1–3. The upper hook units 20 attach the rigid shell 10 to the vertical posts 5 and, as described below, provide for angular adjustment of the rigid shell 10, as well as adjusting to accommodate various widths of wheelchairs. The lower hook units 40 attach the rigid shell 10 to the mounting units 60, which in turn provide for vertical adjustment of the rigid shell 10 with respect to vertical posts 5. The lower hook units 40, best seen in FIG. 4, also adjust to accommodate various widths of wheelchairs, as well as accommodating two possible orientations of the lower mounting units 60 (inside, as shown, or outside the vertical posts 5).

Figure 17:
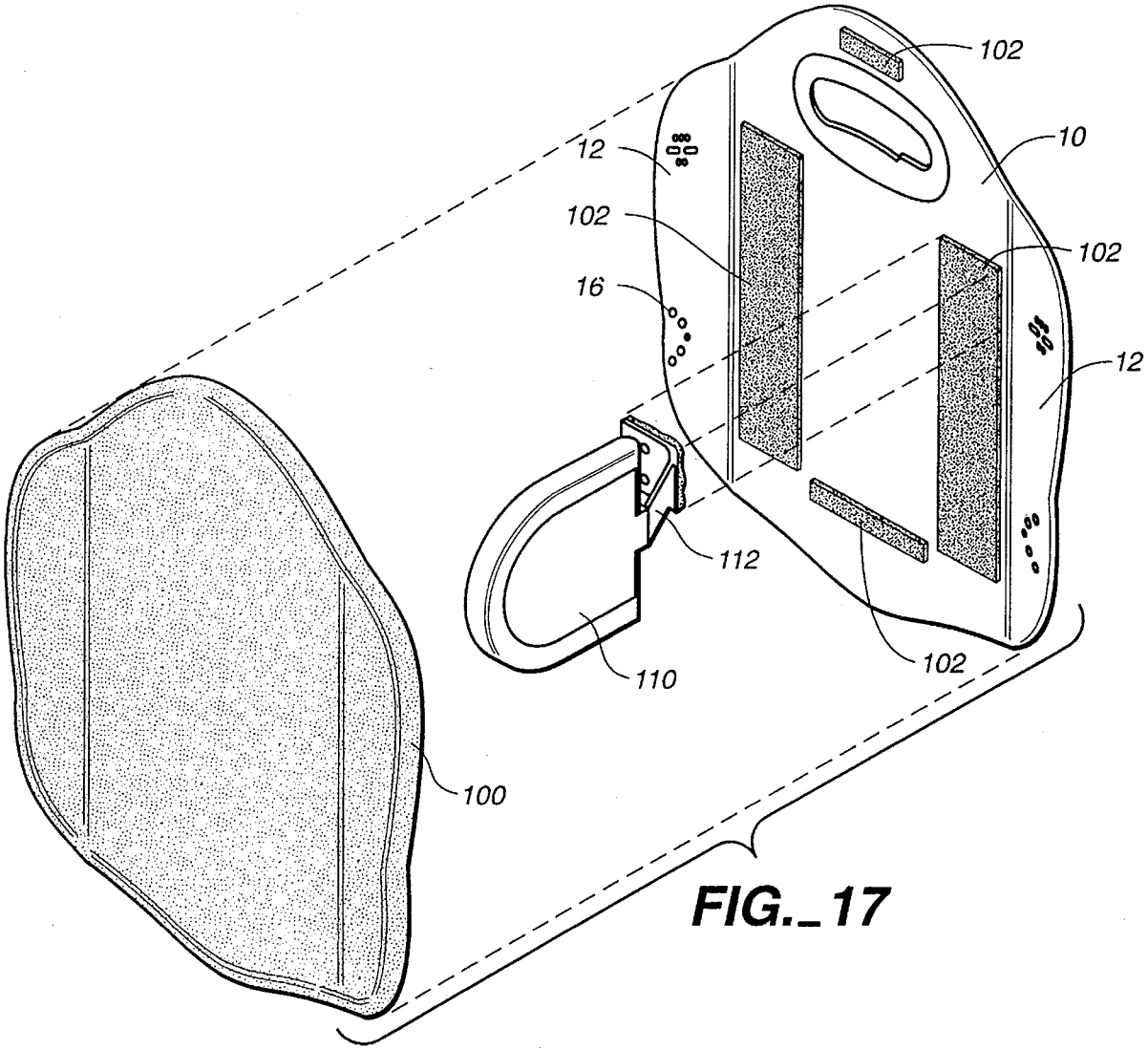
FIG. 17 is a front isometric view of a rigid shell, a lateral support bolster, and a contoured cushion of the type used with the present invention.

As best seen in FIG. 17, a contoured foam cushion 100 is preferably attached to the rigid shell 10 and serves to cushion and support the back of the user. Lateral support bolsters 110 (one shown) may also be removably or permanently affixed to the rigid shell 10 to provide additional lateral support to the wheelchair user.

The cover of the contoured foam cushion 100 is adapted to cover and contain the foam cushion and any associated lumbar shims (not shown), as well as providing means for securing the cushion 100 and associated lumbar shims to the rigid shell 10.

Figure 18:
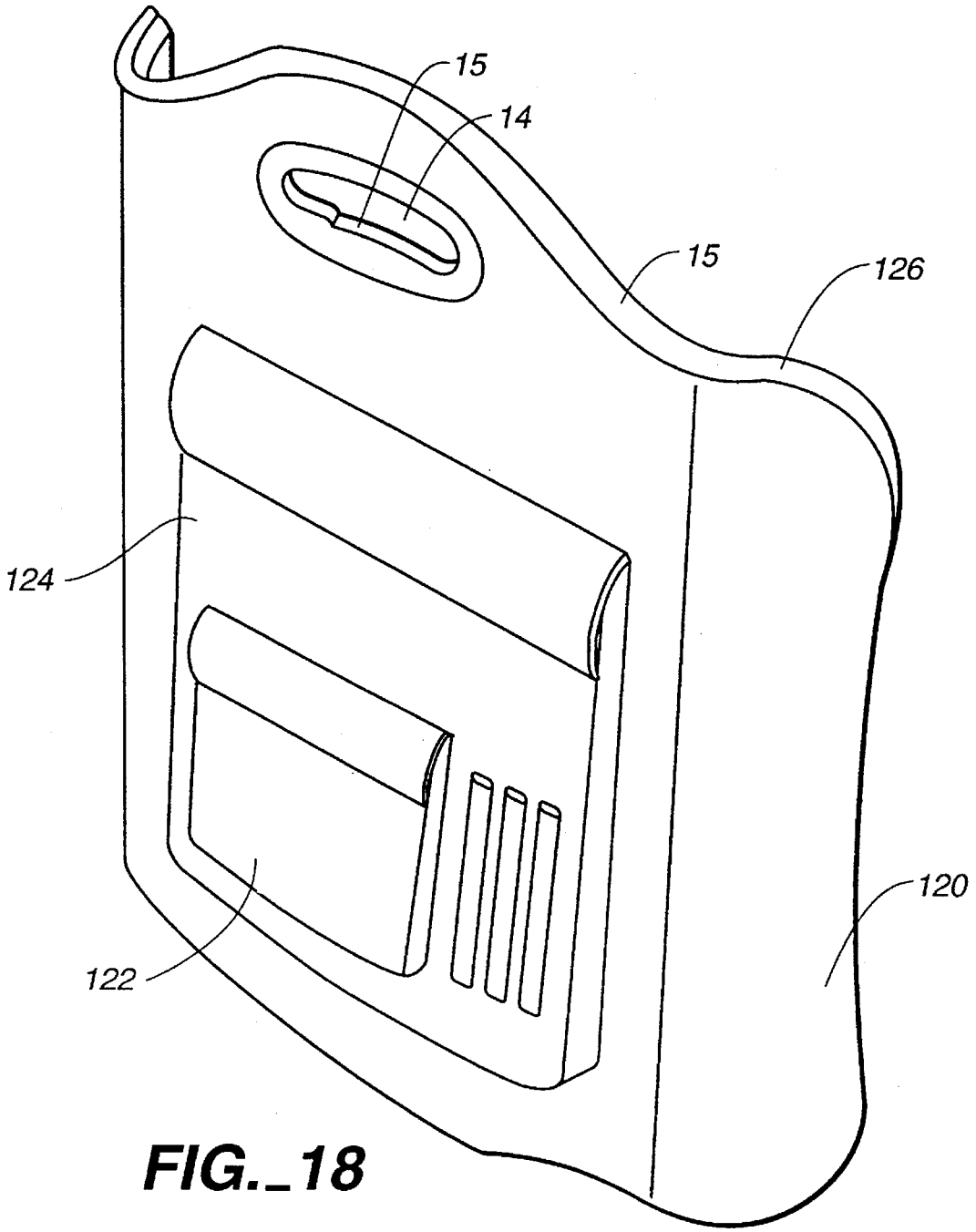
FIG. 18 is a rear isometric view of the rigid shell with attached textile cover and storage pockets of the present invention.

Further, as seen in FIG. 18, a separate textile back cover 120 attaches over the back surface of the rigid shell 10 and serves to cover the shell and to provide carrying pockets and pouches 122, 124 for personal items and the like.

THE SHELL

The shell 10 is a hard rigid matrix which extends between the wheelchair posts 5 and provides mechanical support for the back system. In the preferred embodiment, the shell 10 is produced from an aluminum alloy about 50 to 100 mils thick. The overall width of the shell 10 should not extend beyond the internal minimum width of the vertical posts 5 for the size range of wheelchairs that the particular back size is designed. It is necessary that the extreme width of the rigid shell 10 will clear the inside of the posts 5 so that the shell 10 may be reclined through the open width between the vertical posts 5, as seen in FIGS. 1–3. The central portion of the shell 10 may have a slight convex curvature. A hand grip cut-out 14 is provided at the upper central portion of the rigid shell 10 to facilitate handling of the back during removal or installation from the mounting system. The potentially exposed hard edges of the rigid shell 10 are preferably fitted with a rubber extrusion 15 around its perimeter and around the handle cut-out 14, as seen in FIG. 18. The lateral portions 12 of the rigid shell 10 extend forwardly and outward at approximately a 45 degree angle. The profile of the back is designed to fit either conventional folding wheelchairs, which typically have only a pair of upwardly extending tubular posts, or to fit a rigid non-folding wheelchair, which differs from the folding type in that a formed tubular structure (not shown) extends between the vertical posts 5 for added stability.

Figure 4:
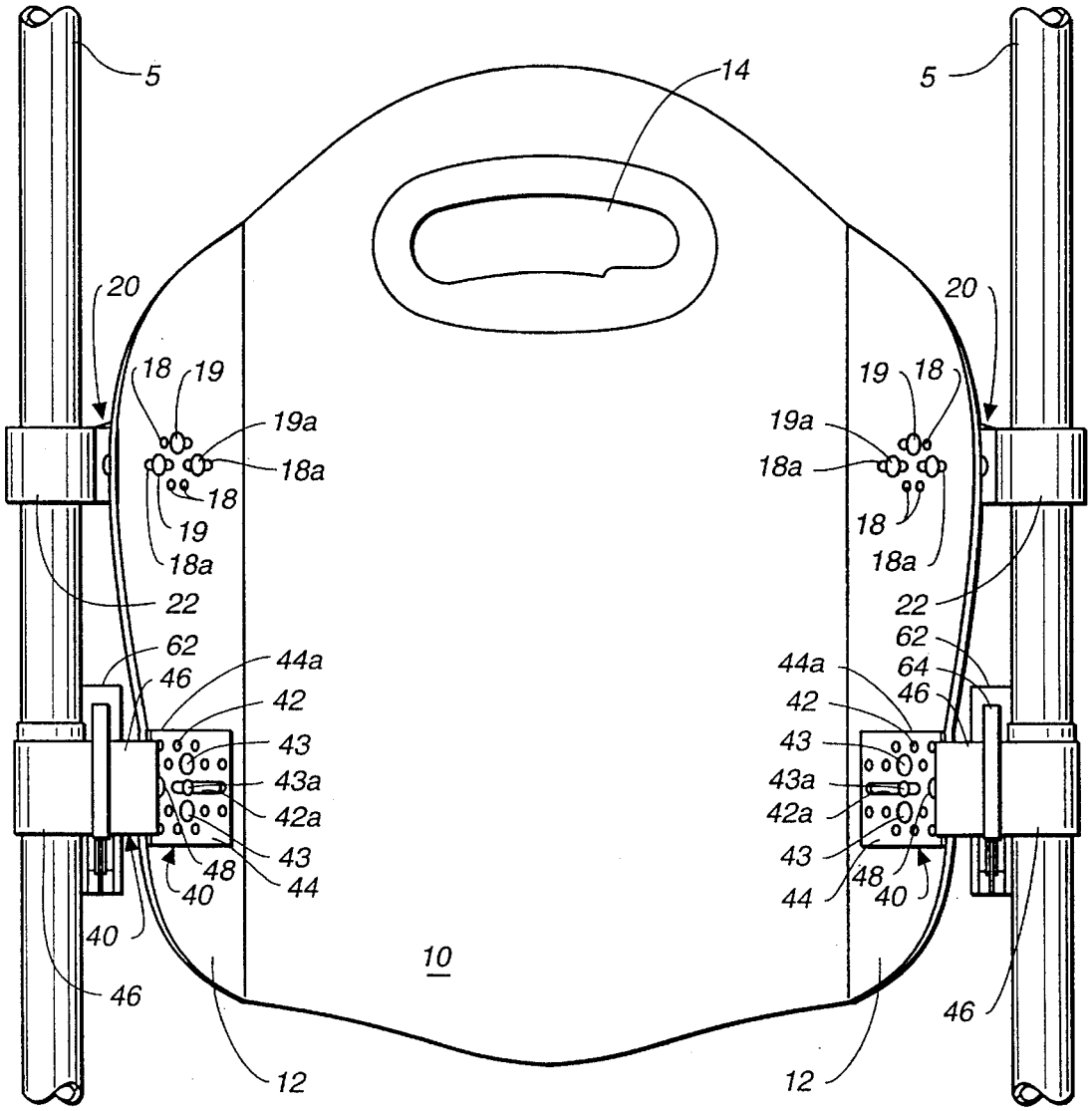
FIG. 4 is a front view of the back system of the present invention mounted on a pair of wheelchair posts.
Figure 19:
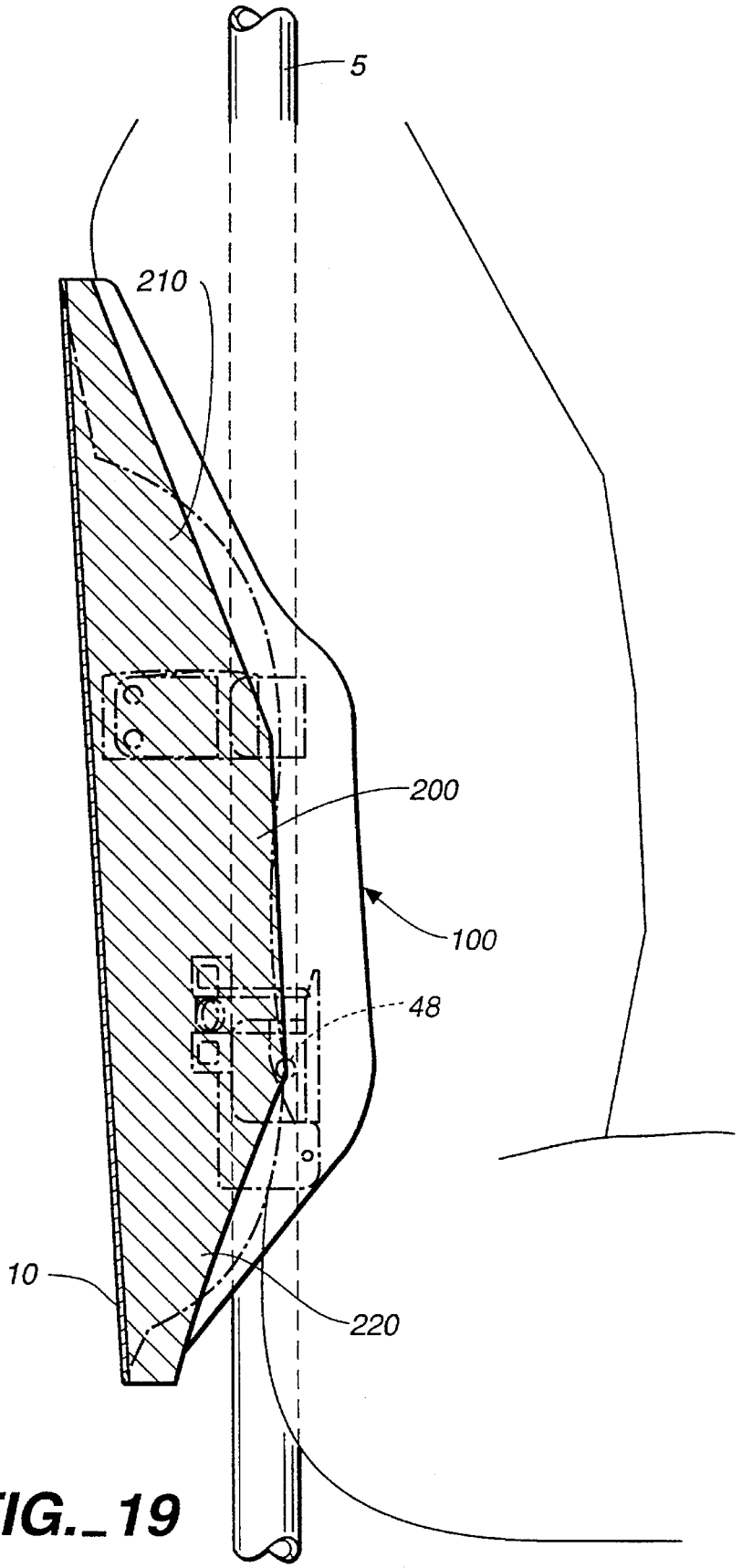
FIG. 19 is a side diagramatic view of the back system of the present invention, including a contoured cushion, with a seated user in place.
Figure 20:
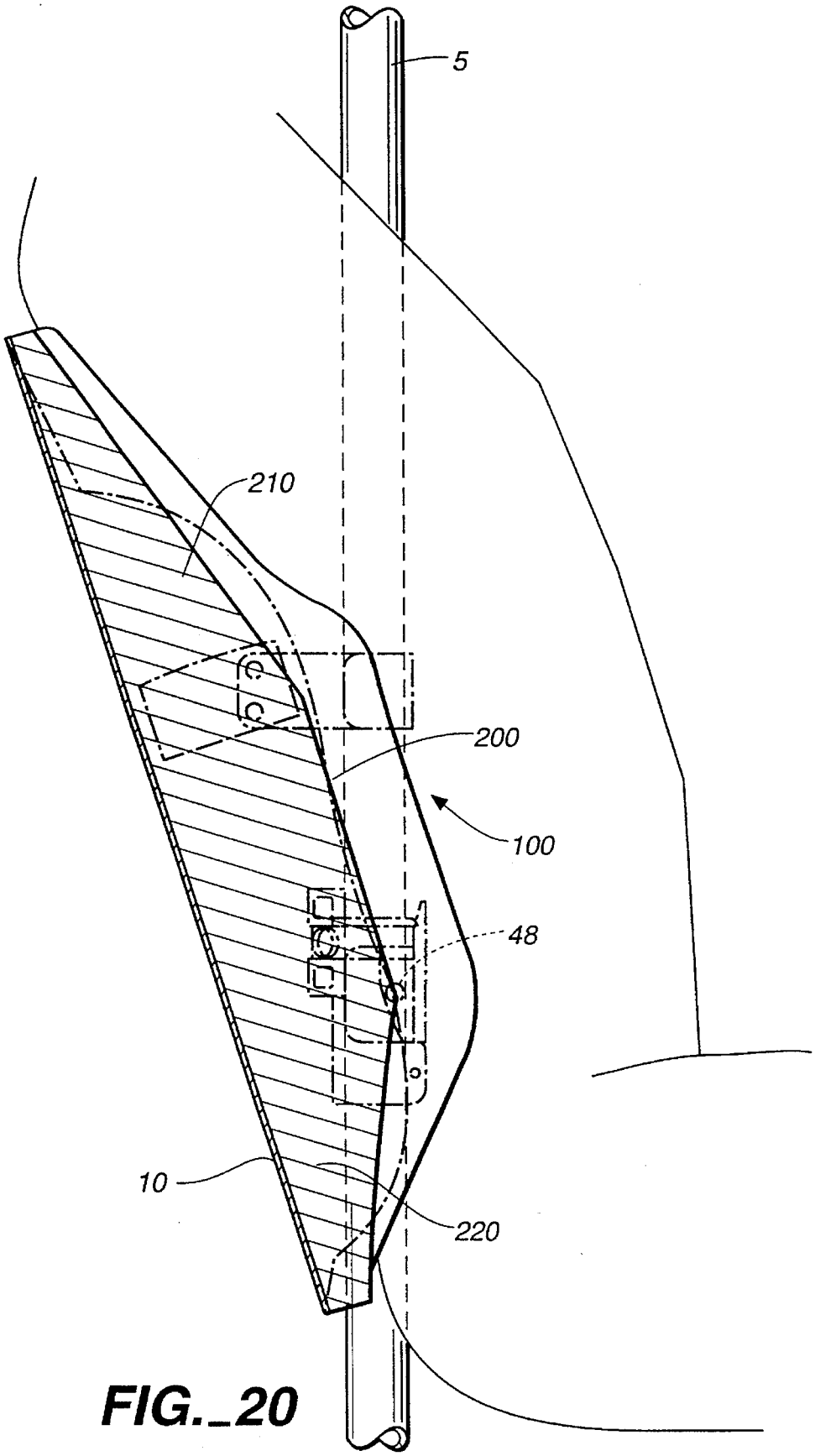
FIG. 20 is a side diagramatic view as in FIG. 19, but with the back system and user reclined.

The lateral portions 12 of the rigid shell 10 are essentially flat and provide an excellent surface to mount the upper and lower hook units 20, 40, as well as to provide support for the cushion 100 and associated accessories such as bolsters 110 for lateral support. Lower mounting holes 16 are punched in the lateral portions 12 of the shell 10 at both the lower hook unit locations (about 20–30% from the bottom of the shell), as best seen in FIG. 1. This distance corresponds to a level equivalent to the seat user's preferred pelvic alignment control points (posterior iliac crests), as best seen in FIGS. 19 and 20. Upper mounting holes 18 and slots 18*a* are punched in the lateral portions 12 of the shell 10 at the upper hook unit locations (about 60–70% from the bottom of the shell), as best seen in FIG. 4. This distance from the bottom of the shell to the upper hook units provides sufficient structural support and balance to the back system. The upper and lower hook units 20, 40 are permanently, but adjustably, attached in their respective locations to the rigid shell at these locations. The individual circular holes 18 adjacent to the slotted holes 18*a* allow for selected placement and indexing of the upper hook units 20 along the range of the slotted holes 18*a*. The lower hook units 40 may optionally be mounted similarly; however, it is also suitable that the lower hook units 40 have slotted holes 42*a* located in the hook units 40 themselves, as best seen in FIG. 4.

The available range of adjustment of the upper and lower hook units 20, 40 with respect to the rigid shell 10 is determined by the length of the slotted holes 18*a*, 42*a* and corresponds to the designed range of width adjustability of the particular back size. The slotted holes 18*a* and 42*a* are preferably permanently fastened with rivets 19*a*, 43*a* so as to allow for sliding of the hook units 20, 40 relative to the rigid shell 10. Optionally rivets 19*a*, 43*a* may be replaced with machine screws, shoulder bolts, or the like. One or more screws 19, 43 are then used to secure the upper and lower hook units 20, 40 to the rigid shell 10.

The reason for the redundant fastener connections (i.e., rivets and screws) at each of the upper and lower hook unit locations is to prevent the user from inadvertently detaching or loosening the hook units 20, 40 from their semi-permanent locations. Thus, if the user fails to adequately tighten the user accessible screws 19, 43 during adjustment procedures, the back will still safely support the load of the user through the non-removable rivets 19*a*, 43*a* that connect the upper and lower hook units 20, 40 to their respective anchoring points on the rigid shell 10.

THE UPPER HOOK UNITS

Figure 7:
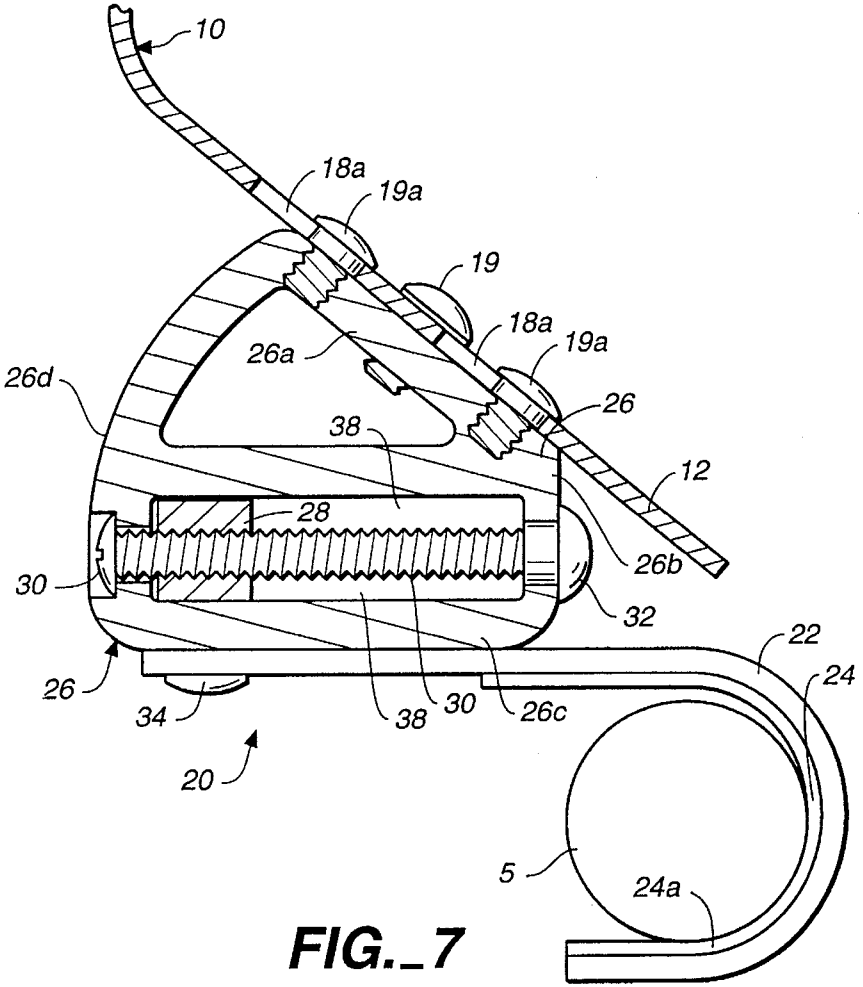
FIG. 7 is a top cross-sectional view of the upper hook unit through line B—B of FIG. 5.

The upper hook units 20 are a mirrored (left/right) pair of assemblies consisting of, as best seen in FIG. 7, an upper hook member 22, upper hook pad 24, upper hook bracket 26, adjuster block 28, drive screw 30, drive screw retaining nut 32, and upper hook mounting rivets 34 (two). The upper hook bracket 26 is preferably made from injection molded plastic to minimize the cost and weight of the component. The preferred configuration has four sides 26*a*–*d*, a slightly convex top 26*e*, best seen in FIG. 5, and an open bottom.

Figure 6:
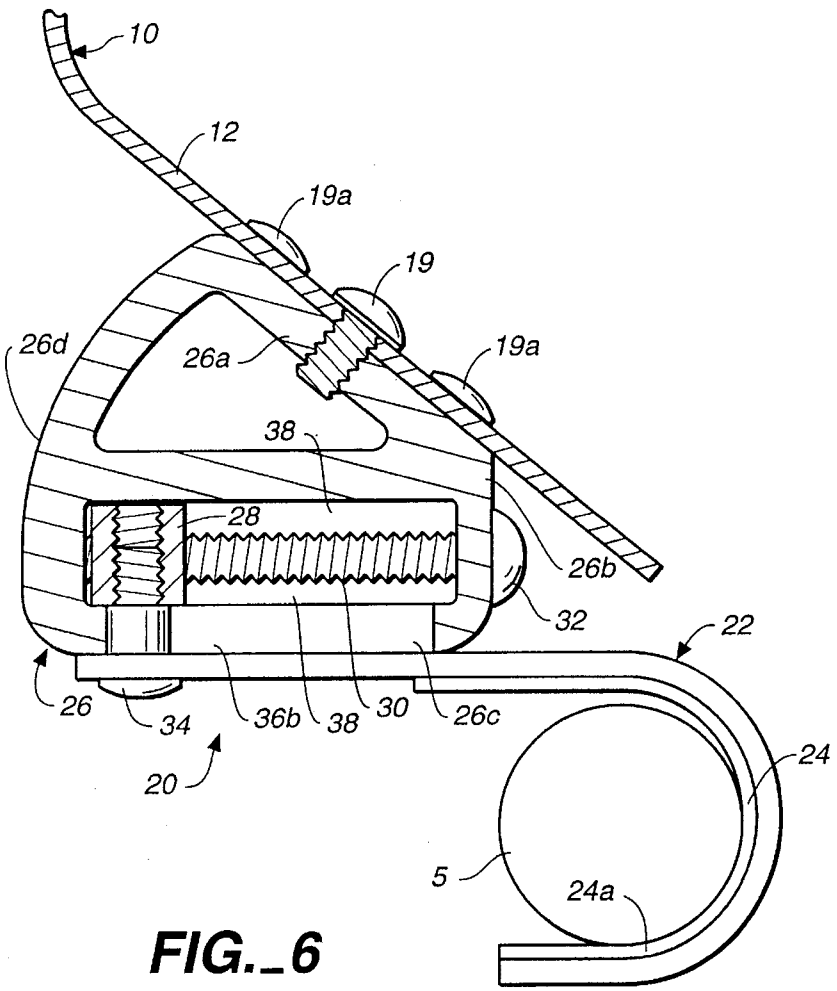
FIG. 6 is a top cross-sectional view of the upper hook unit through line A—A of FIG. 5.

As best seen in FIG. 7, the first side 26*a* of the upper hook bracket 26 is mounted parallel to, and flush against, the rear surface of the lateral portion 12 of the rigid shell 10. A pair of rivets 19*a* attach the upper hook bracket 26 to the rigid shell 10 through the slotted holes 18*a*. As best seen in FIG. 6, a threaded screw 19 (which may optionally include a threaded anchor, not shown) is fastened in the first side 26*a* of the bracket 26 through one of the holes 18, as best seen in FIG. 4, in the lateral portion 12 of the rigid shell 10 in order to secure the upper hook bracket in place. Rivet 19*a* has a shoulder or stand-off to maintain sliding attachments of upper hook unit 20 to shell 10. To adjust the position of the upper hook unit 20, the bracket 26 is simply slid to the desired position, so that the threaded hole in the side 26*a* of the upper hook bracket 26 aligns with one of the holes 18 of the rigid shell 10, and then fixed in place with the screw 19. Also, although the screw 19 is necessary to secure the upper hook bracket 26 in a specific position, if it were unintentionally removed the rivets 19*a* would prevent the upper hook unit 20 from detaching completely.

The second side 26*b* of the upper hook bracket 26 is rotated about 135 degrees counterclockwise from the first side 26*a* and extends about ¾ of an inch parallel to the lateral plane of the back system. The second side 26*b* provides for location, and corresponding axial load bearing, of the drive screw retaining nut 32.

The third side 26*c* of the upper hook bracket 26 is perpendicular to the second side 26*b* and extends rearwardly about 2 inches. Two parallel slots 36*a*, 36*b* extend through the side 26*c* and extend for about 1½ inches, as best seen (partially) in FIG. 1.

Figure 5:
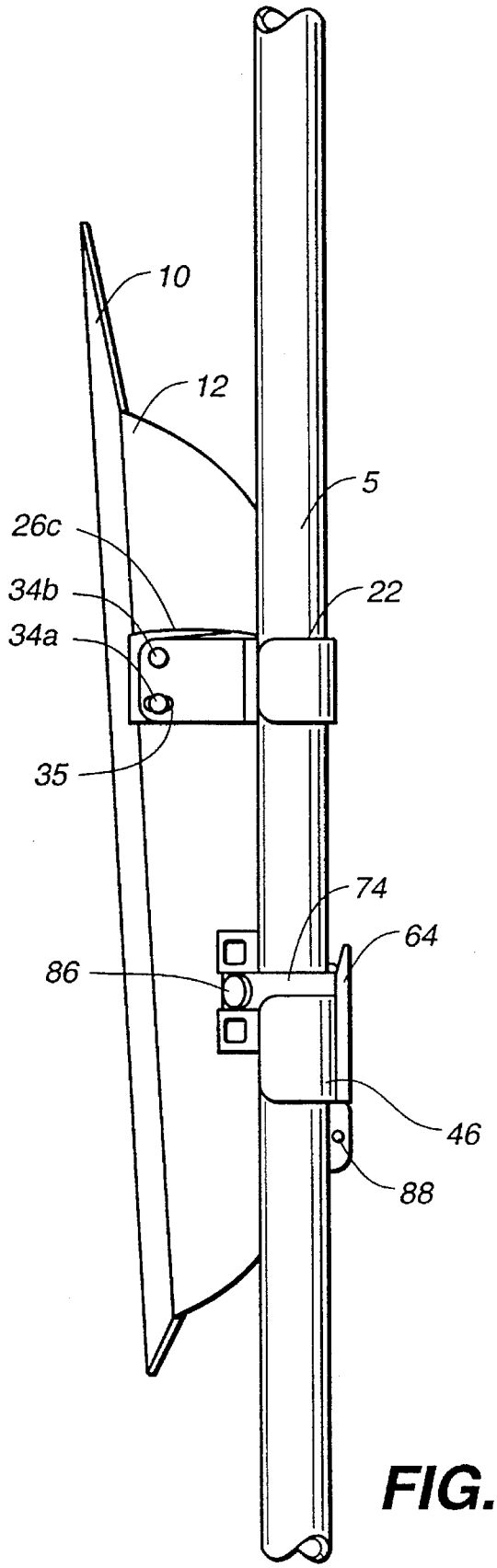
FIG. 5 is a side view of the back system shown in FIG. 4.

The upper hook 22 is fastened to the upper hook bracket 26 by a pair of mounting rivets 34*a*, 34*b*, as best seen in FIGS. 1 and 5, that extend through the slots 36*a*, 36*b* and into the adjuster block 28 as best seen in FIG. 6. As seen in FIG. 1, the bottom hole 35 through the upper hook member 22, through which the lower rivet 34*a* extends, is made to be slightly elongated and upwardly curved. This allows the upper hook member 22 to pivot freely approximately 15–25 degrees around the axis of the upper rivet 34*b*, thereby providing for angular compensation as the rigid shell 10 is reclined so as to maintain the upper hook member 22 flush against the wheelchair post 5.

The adjuster block 28 to which the upper hook member 22 is attached is located in an elongated pocket 38 defined by the internal walls of the upper hook bracket 26. As best seen in FIG. 7, the adjuster block 28 has a threaded hole in it through which the drive screw 30 extends. The tip of the drive screw 30 is retained by the drive screw retaining nut 32. When the drive screw 30 is turned, the adjuster block 28 is thereby propelled by the turning screw threads forward or backward within the pocket 38. This in turn moves the upper hook 22 forward or backward so as to adjust the angulation of the rigid shell 10 relative to the wheelchair posts 5. The adjuster block 28 is preferably machined from metal sufficient to support the axial loads transmitted from the rigid shell 10 to the upper hook member 22 via the drive screw 30. The length of the slots 36*a*, 36*b* and pocket 38 ultimately define the total range that a user can adjust the position of the upper hook member 22 and, thus, the recline of the rigid shell 10 and the back system as a whole.

The fourth side 26*d* of the upper hook bracket 26 extends between the first and third sides 26*a*, 26*c* and may be curved to present a more aesthetically pleasing component.

The upper hook member 22 also preferably includes a hook pad 24 glued along the inside radius of the upper hook member 22 to protect the vertical wheelchair posts 5 from damage due to abrasion between the upper hook member 22 and the vertical wheelchair post 5. It will also be apparent that the nominal recline of the back system can be set by varying the length of the attaching side of the upper hook member 22. In other words, the longer the upper hook member 22 is, the greater the nominal recline of the rigid shell 10 will be.

Also, the entire upper hook unit 20 is optimally mounted and adjusted with respect to the rigid shell 10 so that the outermost portion 24*a* of the upper hook pad 24 bears against the vertical wheelchair post 5. This adjustment of the upper hook unit to bear against the outside of the post 5 provides additional rigidity to the wheelchair frame and also facilitates the installation of the back system to wheelchair by guiding the upper hook members 22 down the posts 5.

LOWER HOOK UNITS

Figure 8:
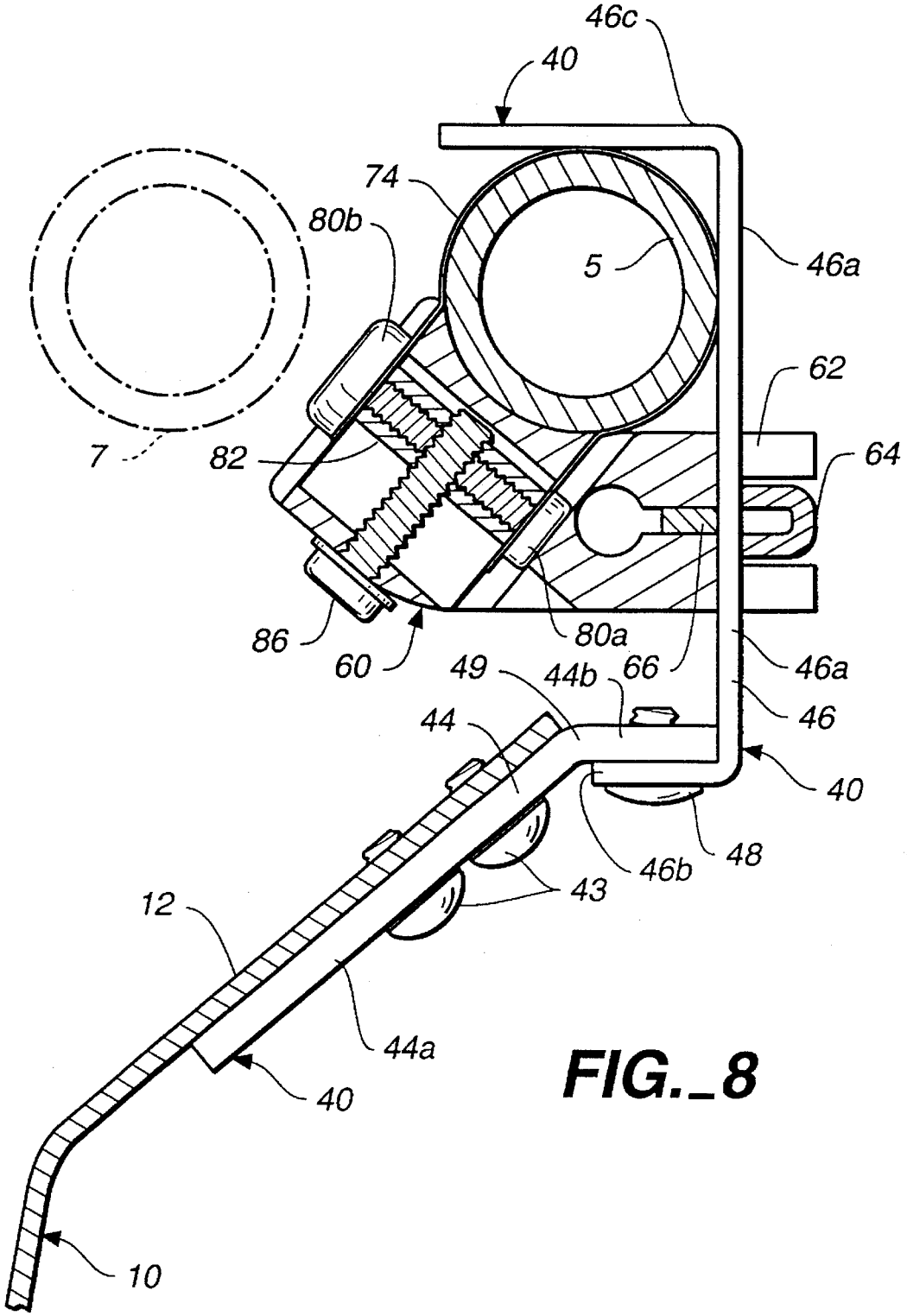
FIG. 8 is a top cross-sectional view of the lower hook unit and mounting unit through line C—C of FIG. 5.

The lower hook units 40 are a mirrored (left/right) pair of assemblies consisting of, as best seen in FIGS. 4 and 8–12, a bracket plate 44, a hook member 46, and a hook member fastener bolt 48. As best seen in FIG. 8, the bracket plate 44 has a bend 49 defining two segments 44*a*, 44*b*. The first segment 44*a* is parallel to, and fits flush against, the lateral portion 12 of the rigid shell 10, and extends for about 2½ inches inward from the edge of the rigid shell 10. The second segment 44*b* extends from the forwardmost, outer edge of segment 44*a* for about ½ inches and is angled forward from the first segment 44*a* by about 45 degrees.

Figure 9:
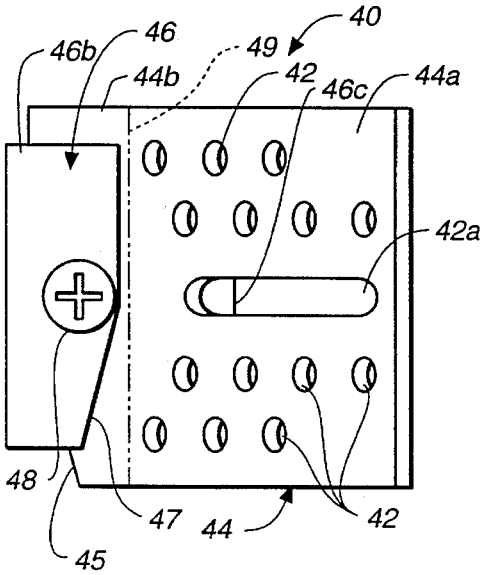
FIGS. 9–10 are side views of a lower hook unit in a straight and rotated position.
Figure 11:
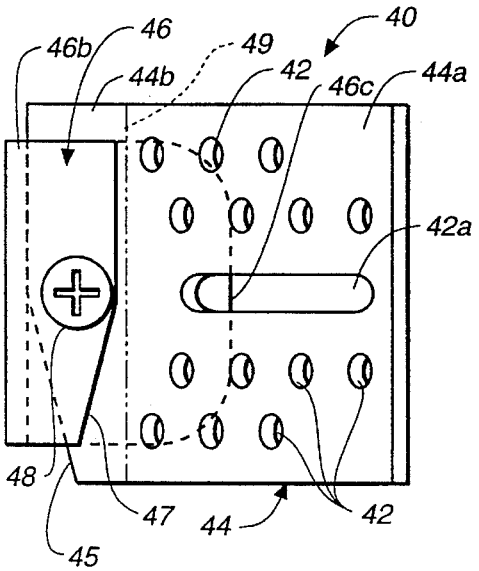
FIGS. 11–12 are the same as FIGS. 9–10, but with dashed lines showing the outline of features otherwise obscured.

As best seen in FIGS. 4 and 9, the first segment 44*a* of the bracket plate 44 is essentially rectangular and is punched with slots 42*a* and holes 42 to permit attachment to the lateral portion 12 on the inside of the rigid shell 10, as previously discussed. As best seen in FIGS. 9–12, the second segment 44*b* is also generally rectangular, but with a chamfered portion 45 extending at about a 15–25 degree angle along the forward edge of the second segment 44*b*, from about midway down to the bottom edge of the segment, as best seen by a partially dashed line in FIGS. 11 and 12. A hook member fastener bolt 48 extends through a hole in the hook member 46 and into a threaded hole in the second segment 44*b* of the bracket plate 44, thereby connecting the hook member 46 to the bracket plate 44, as best seen from above in FIG. 8.

As best seen in FIG. 8, the hook member 46 is a U-shaped metal band with essentially three straight sides 46*a*, 46*b*, 46*c*. The innermost side 46*b* mates flush against the second segment 44*b* of the bracket plate 44 and has a hole with a bushing (not shown) through which the hook member fastener bolt 48 extends in order to fasten the bracket plate 44 to the hook member 46. The bushing helps prevents the hook member 46 from binding on the bracket plate 44.

Also, as best seen in FIGS. 9–12, the rear edge of the innermost side 46*b* has a chamfered portion 47 similar to the forward edge 45 of the bracket plate 44. The single hook member fastener bolt 48, in conjunction with the two chamfered portions 45, 47, described above, permits the hook member 46 to pivot rotationally through a limited range with respect to the bracket plate 44 and, ultimately, the attached rigid shell 10.

Figure 10:
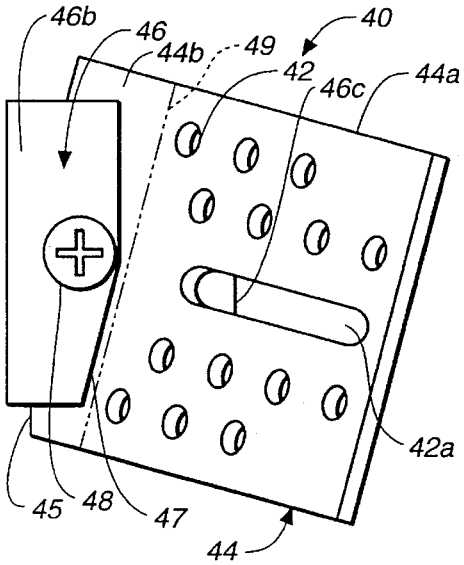
Figure 12:
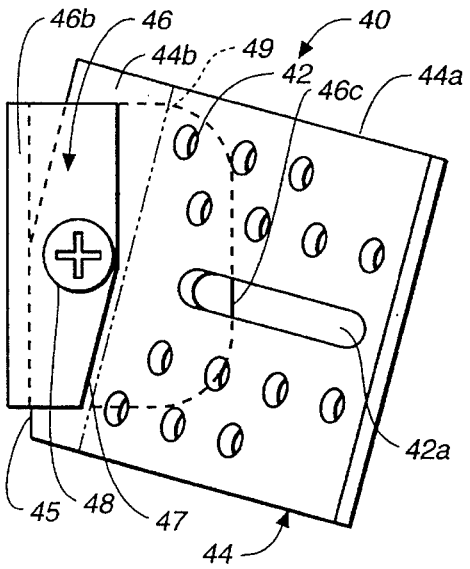

FIGS. 10 and 12 show the relationship between the bracket plate 44 and the hook member 46 when the bracket plate 46 is rotated back, as would be the case when the attached rigid shell 10 (not shown in FIGS. 9–12) is fully reclined. As can be seen from these figures, the chamfered portions 45, 47, described above, are necessary to prevent the bracket plate 44 and hook member 46 from binding. This allows the front side 46*a* of hook member 46 to remain parallel to the vertical wheelchair posts 5 even when the rigid shell 10 is reclined.

The front side 46*a* of the hook member 46 is the side that actually engages the mounting unit 60, as discussed in detail below. The proper length of the front side 46*a* is determined by the sum of the maximum dimensions of the anticipated vertical wheelchair post 5 diameters and the maximum width of the mounting unit 60.

The outermost side 46*c* of the hook member 46 extends rearwardly from and perpendicular to the front side 46*a*. Preferably, the inside face of the outermost side 46*c* should bear against the outside surface of the corresponding adjacent vertical wheelchair post 5, as shown in FIG. 8. As noted above in connection with the upper hook units, proper adjustment of the lower hook unit to bear against the outside of the post 5 provides additional rigidity to the wheelchair frame and also facilitates the installation of the back system to the wheelchair by guiding the lower hook members 46 down the posts 5.

THE MOUNTING UNITS

The mounting units 60 are mirrored (left/right) assemblies including a housing 62, retaining arm 64, and pawl arm 66, as well as various other internal and mounting components, described below. The basic function of the mounting unit 60 is to removably attach the rigid shell 10 of the back system to the wheelchair vertical posts 5 via the lower hook units 40. As best seen in FIG. 2, the hook member 46 is latched between the retaining arm 64 and pawl arm 66 of the mounting unit 60.

Figure 13:
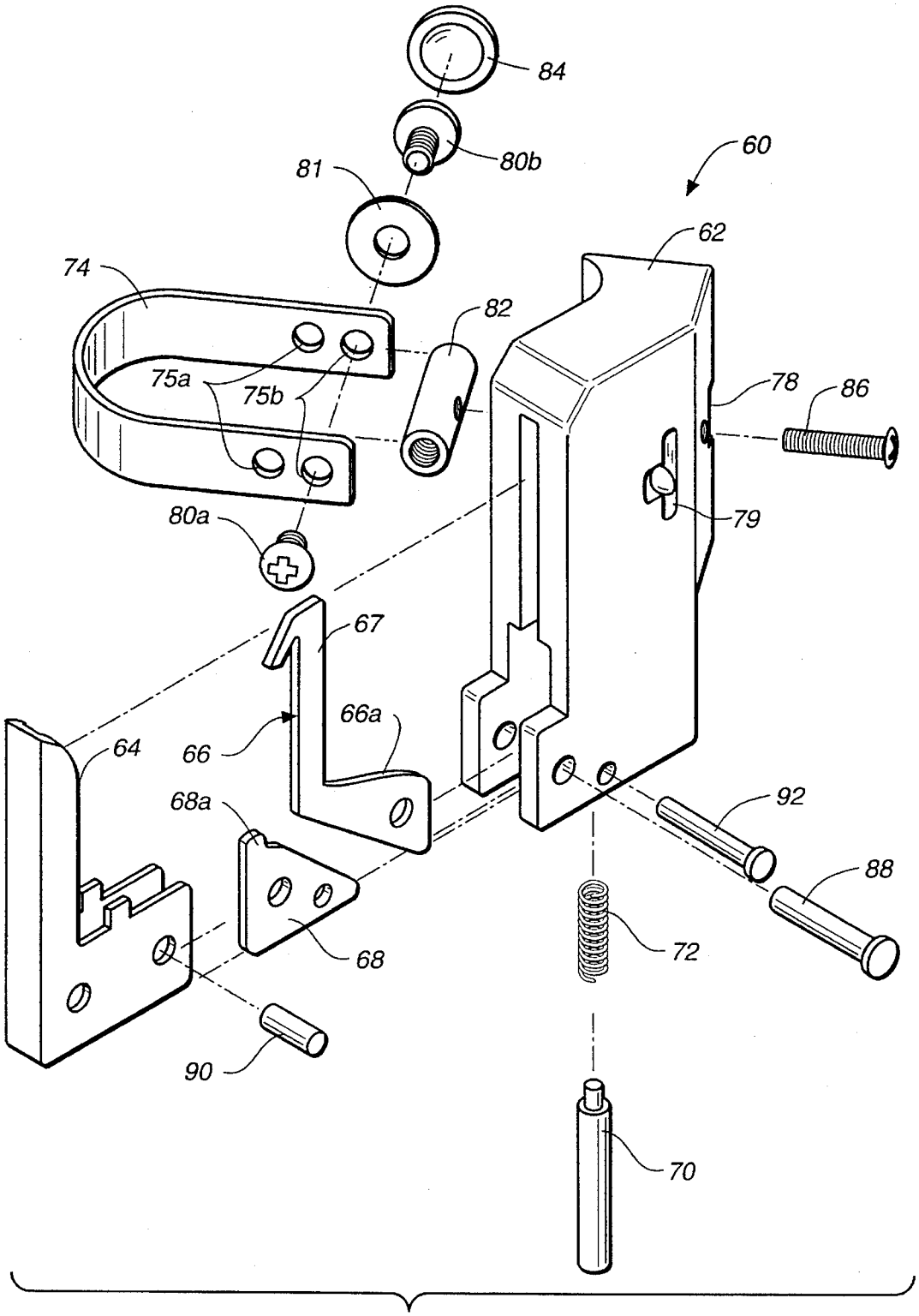
FIG. 13 is an exploded view of a mounting unit of the invention.
Figure 15:
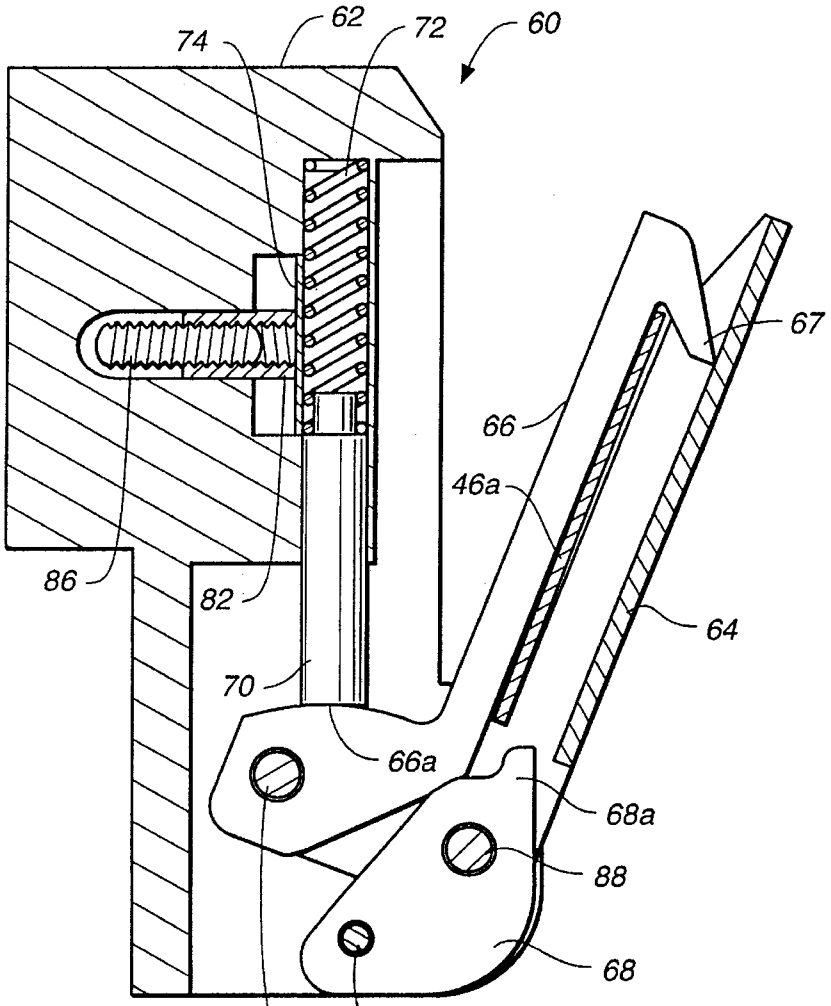
FIG. 15 is a side cross-sectional view of the mounting unit in a partially extended position.

As best seen in FIGS. 8 and 13, the mounting unit 60 is provided with a strap 74 to wrap around and clamp the upper portion of the housing 62 to the tubular vertical posts 5. One end of the strap 74 is aligned in a groove 78 and the other end fits through a slot 79 of the housing 62 and is attached with attachment screws 80*a*, 80*b* and barrel nut 82. A bushing 81 is used to attach a cap 84 that may be used to cover the screw head if desired. Clamping of the mounting unit housing 62 to the tubular vertical post 5 is achieved by tightening the drive screw 86, which draws the barrel nut 82 through a slot (not shown) within the housing 62 and correspondingly pulls the strap 74 tight around the vertical posts 5. The strap 74 is preferably provided with two sets of punched mounting holes 75*a*, 75*b* in order to accommodate different diameter posts. The outermost set of mounting holes 75*b* will clamp a tubular diameter of 0.75" through 1" and the innermost set of mounting holes 75*a* will clamp a tubular diameter of 0.50" through 75". The strap 74 is preferably made from small gage (15–30 mils) high strength metal alloy such as stainless steel.

Viewing the mounting unit 60 from the top, as best seen in FIG. 8, the strap 74, drive screw 86 and associated hardware are rotated rearward and inward at an angle of about 45 degrees towards the center of the back system to provide clearance for a typically encounter armrest support tube 7 (shown by dashed lines) which normally occupies the space behind and adjacent to the vertical upright posts 5. The mounting unit housing 62 position and clamping force can be adjusted by drive screw 86 without interference from such an armrest support tube 7, as seen in FIG. 8.

Clamping the mounting unit 60 to the vertical posts 5 is preferable over prior art systems which required drilling holes into the posts and thus possibly compromising the structural integrity of the wheelchair structure. Moreover, the clamping system of the present invention provides a much more conveniently adjustable attachment system. Also, the mirror left and right configurations of the mounting units 60 allow for their optional installation to the outside of the vertical wheelchair posts 5.

The housing 62 of the mounting unit 60 is preferably made from a high strength injection molded plastic such as nylon. As best seen in FIGS. 13–16, the housing 62 contains the working components of the mounting unit 60. Specifically, a pawl arm 66, retaining arm 64, and a cam 68 are mounted on pins 88, 90, 92 and interact together so that the mounting unit 60 will securely hold the lower hook unit 40 until it is intentionally released by pulling forward on the top of the rigid shell 10.

Figure 14:
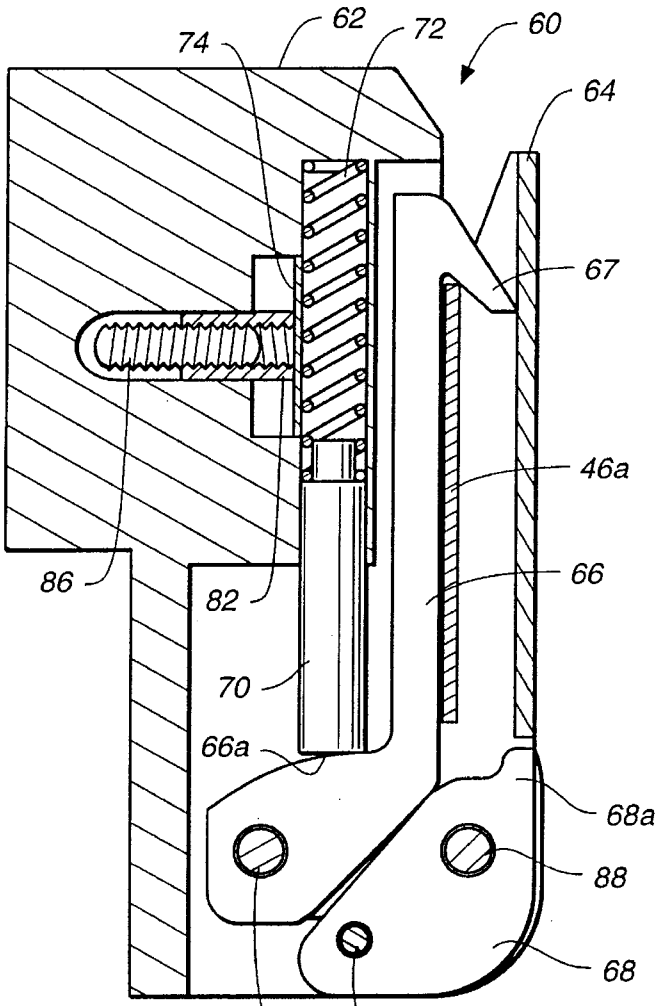
FIG. 14 is a side cross-sectional view of the mounting unit in a fully retracted position.

The retaining arm 64 is connected to a pivot point on the housing with a pivot pin 88. The retaining arm 64 is preferably a formed sheet metal C-shaped channel, as best seen in FIGS. 3 and 8, and thereby forms a vertically extending slot which receives the latching tip portion 67 of the pawl arm 66. The pawl arm 66 is connected to the retaining arm 64 by a connecting pin 90 and is free to rotate with respect to the retaining arm 64 about the connecting pin 90. The pawl arm 66 is preferably a stamped high strength sheet metal piece with the latching tip portion 67 at the upper end to capture the upper edge of the engaged lower hook member 46, as best seen in FIGS. 2 and 14. The pawl arm 66 and retaining arm 64 preferably have a bevel form at their upper ends to facilitate the insertion of the hook member 46 between them.

Both the pawl arm 66 and retaining arm 64 have curved upper edges on their base portions to interface with the plunger 70, which is biased downward by a spring 72 against the upper edges of the pawl arm 66 and the retaining arm 64. The plunger 70 and spring 72 are located and retained in an upwardly extending hole in the housing 62. The upper curved edge 66*a* of the pawl arm 66 extends slightly beyond the edge of retaining arm 64 to ensure that the pawl arm 66 is spring loaded closed with respect to the retaining arm, thus locking an engaged lower hook member 46 securely in the space formed between the retaining arm 64 and the pawl arm 66.

The plunger 70 is preferably made of a material such as nylon to minimize the friction between the sliding surfaces of the plunger 70 and the adjacent edges of the retaining arm 64 and pawl arm 66. As noted above, bevels on the upper ends of the retaining arm 64 and the pawl arm 66, as well as on the housing 62, guide the bottom edge of the hook member 46 during insertion into the space formed between the retaining arm 65 and pawl arm 66.

Figure 16:
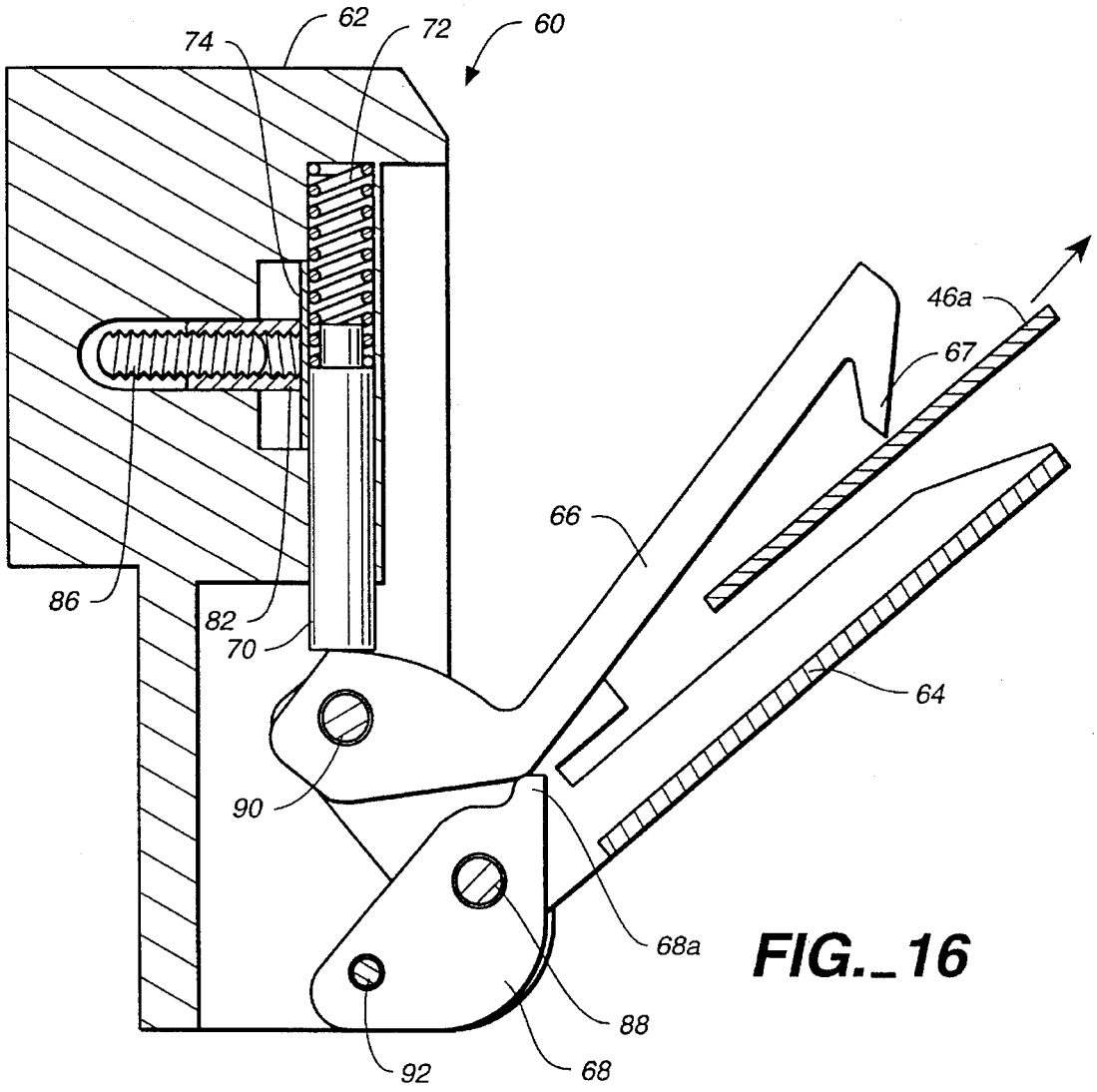
FIG. 16 is a side cross-sectional view of the mounting unit in a fully extended position.

The lower hook units 40, and the attached rigid shell 10, are removed from mounting units 60 simply by rotating the rigid shell 10 forward about the pivot point 88 in the mounting units housing 62, as best seen in FIGS. 3 and 16. As this occurs, the retaining arm 64 and pawl arm 66 follow the rotational motion of the hook member 46 until a prescribe angle of about 45 degrees from the plain of the vertical posts 5 is reached. When that point is reached, as best seen in FIG. 16, the lower edge of the pawl arm 66 rides up on the lobe surface 68*a* of the cam 68 and causes the latching tip 67 of the pawl arm 66 to rotate away from the retaining arm 64. The lower hook units 40 are then free to exit the space previously formed by the closed pawl arm 66 and retaining arm 64, and the rigid shell 10 can be removed from the wheelchair posts 5, as best seen in FIG. 3. The cam 68 is retained in a C-shaped channel of the retaining arm 64 by the pivot pin 88. The cam 68 is prevented from rotating with respect to the housing 62 by the lock pin 92, as best seen in FIGS. 13–16.

FIGS. 1–3 show progressive steps in the removal of the back system from the posts 5 of a wheelchair. In FIG. 1, the rigid shell 10 is in a fully installed, upright position, with the upper hook units 20 in place against the vertical wheelchair posts 5, and the lower hook units 40 secured in place by the mounting units 60. In FIG. 2, the rigid shell 10 has been rotated partially forward so that the upper hooks 22 no longer engage the wheelchair posts 5, and the lower hook members 46 have rotated the retaining arms 64 and pawl arms 66 partially out from the mounting unit housings 62. It should be noted, however, that the retaining arms 64 and pawl arms 66 are still sufficiently together in FIG. 2 to prevent the lower hook members 46 from being removed. In FIG. 3, the rigid shell 10 and hook members 46 have now been rotated forward far enough so that the retaining arms 64 and pawl arms 66 are separated and the lower hook members 46 can be lifted out of the mounting units 60.

As described above, it can be seen that the mounting units 60 in the preferred embodiment of the invention provide an exceptionally easy and convenient mechanism for attaching the lower hooks to the wheelchair posts 5. The mounting units are automatically actuated to latch or secure the lower hooks into position simply by sliding the hook members 46 into the mounting units 60. Removal is accomplished just as easily by simply pulling the rigid shell 10 forward and lifting it up. Moreover, despite the ease of removal and installation, the back system is quite stable and safe when in use. Indeed, the one time it cannot easily be removed is when a user is seated in the wheelchair, which prevents accidental disengagement.

THE CUSHION

The cushion 100 (within a cover), as best seen in FIGS. 17 and 19–20, is preferably fabricated from an open cell polyurethane foam because it is relatively light in weight, although other materials may be used. The cushion 100 preferably extends throughout a well defined by the rigid shell 10. The height of the cushion 100 may be approximately the same as the rigid shell 10. The rear face of the foam cushion 100 that is supported by the rigid shell has essentially the same profile as the corresponding rigid shell 10, except that it preferably extends laterally beyond lateral portions 12 of shell 10 so as to minimize user contact with lower mounting units 16. The forward face of the foam cushion 100 (the surface that supports the seated user) is specifically contoured to provide the appropriate amount of positioning and support to the seated user. The forward foam surface has three vertically spaced segments, all of which are generally contoured from side to side with a convex curvature designed to maintain the seated user centrally within the back system.

The middle segment 200 of the contoured foam surface is approximately 5–7" high, which corresponds to the typical height of the lower back and lumbar support area of the typical user. The middle segment 200 of the contoured foam surface is essentially parallel to the central vertical portion of the rigid shell 10. The upper segment 210 extends upward about 7–12 inches from the middle segment 200 and rearward at an angle of approximately 5 degrees from the vertical plane defined by the middle segment 200. The upper segment 210 corresponds to the typical height of the upper thoracic area of typical user's back. The 5 degree offset is desirable to provide a minimum amount of lumbar curve to the seated user's spine, as best seen in FIG. 19. The lower segment 220 of the contoured foam surface extends downward about 5–6" from the middle segment 200 and slopes rearward at an angle of approximately 15–25 degrees, as best seen in FIGS. 19 and 20. The boundary between the middle and lower segments 200, 210 of the contoured foam is located at the same height as the pivot point 48 between the hook member 46 and lower plate bracket 44, described above. The 15–25 degree offset is desirable to prevent the user's pelvis from being thrust forward as the back is reclined up to 15–25 degrees from the vertical position, as seen in FIG. 20.

THE COVER

The cushion cover 100 is designed to fit over the cushion. The cover totally encases the cushion and any additional supports that may be placed therein. The cover includes five strips of loop fastener (not shown) that engages with hook fastener 102 located in the corresponding positions on the rigid shell 10, seen in FIG. 17.

THE BOLSTERS

Bolsters 110, one of which is shown in FIG. 17, are designed to be removably affixed to the lateral portions 12 of the rigid back shell where they provide lateral support to the user. Preferably the angle bracket 112 is formed from sheet metal and has loop fastener adhered to the back side to permit engagement with the corresponding hook fastener 102 on the rigid shell 10. Alternately, the bracket 112 may be thru bolted to the rigid shell 10 to provide a permanent connection. The bolster 110 may be positioned throughout the range available on the rigid shell 10.

TEXTILE COVER

In further aspect of the present invention, a fabric textile cover 120 that includes pockets 122 or pouches 124 for storing items is fastened to the rear surface of the rigid shell 10, as best seen in FIG. 18. Attachment is preferably accomplished by segments of flexible plastic or rubber extrusion 126 sewn to the perimeter of the textile cover and in turn clipped around the perimeter of the rigid shell 10. The textile cover includes a fabric textile pouch 124 and/or series of smaller fabric textile pockets 122 that are sewn to the cover and thus form an integral back shell back pack for the user to store personal items such as keys, wallet, and the like.

From the foregoing, it can be seen that an improved wheelchair seat back system has been provided that fully meets the objects of the instant invention. While the system has been described in terms of a preferred embodiment, there is no intent to limit the invention to the same. On the contrary, it is intended to cover all modifications and equivalents within the scope of the appended claims. Moreover, it should be emphasized that many variations of the present invention will be apparent to one skilled in the art. For example, many variations of the upper and lower hook units could be used within the scope of the invention. Both hook units could, for example, be incorporated into a single piece, such as an elongated channel or other interconnected arrangement. Likewise, it will be apparent to those skilled in the art that a wide range of adjustment mechanisms and rigid shell shapes could be used, still within the scope of the invention. Various configurations could also be implemented for the mounting units that would still accomplish the desired results and be within the scope of the invention.

What is claimed is:

1. A wheelchair back system for mounting to a pair of spaced apart vertical posts of a wheelchair back frame, comprising:

a relatively rigid shell member;

a pair of upper hooks attached to said shell member proximate opposite sides of said shell member and adapted to be supported by the vertical posts of the wheelchair back frame;

a pair of lower hooks attached to said shell member proximate opposite sides of said shell member and adapted to be supported by the vertical posts of the wheelchair;

a pair of mounting units adapted to be mounted on the vertical posts of the wheelchair and formed to receive and releasably secure at least one of said upper hooks and said lower hooks to said mounting units, said mounting units having a pawl arm and a retaining arm mounted for movement thereto and biased toward each other to positively lock one of said hooks therebetween, said pawl arm and said retaining arm being mounted for movement together in the same direction in a locked condition around said one of said hooks over a limited range of movement to prevent unintentional release of said one of said hooks from said mounting units during use of said wheelchair back system; and said mounting units being further formed to produce relative displacement of said pawl arm and said retaining arm away from each other to automatically release said one of said hooks from said mounting units for removal of said shell member from the wheelchair back frame by displacement of said shell member substantially beyond said limited range of movement.

2. The wheelchair back system of claim 1, wherein said rigid shell member includes a hand grip device; and said mounting units are formed for both single-handed installation and single-handed release of said rigid shell to and from said mounting units.

3. The wheelchair back system of claim 1, wherein said pair of upper hooks are attached to the rigid shell so that the upper hooks are horizontally adjustable.

4. The wheelchair back system of claim 3, wherein the horizontal adjustability is accomplished by using one or more slotted holes through which a fastener attaches the upper hook to the rigid shell.

5. The wheelchair back system as defined in claim 1 wherein, said upper hooks are adjustably mounted to said shell member by a mounting assembly adapted for adjustment of the angle of recline of said rigid shell member relative to the vertical posts of said wheelchair.

6. The wheelchair back system as defined in claim 5 wherein, said upper hooks are mounted by a mounting assembly to said rigid shell member, said mounting assembly being formed for rotation through a limited angle about a horizontal axis running parallel to a plane including the vertical posts of said wheelchair to which the back system is to be mounted, so that said upper hooks can automatically rotate flush against the vertical posts when the angulation of said rigid shell member is changed relative to the vertical posts.

7. The wheelchair back system as defined in claim 1 wherein, said lower hooks include a bracket plate attached to said rigid shell member and a lower hook member, said lower hook member being attached to the bracket plate for rotation through a limited range about a horizontal axis running parallel to a plane including the vertical posts for rotation of said lower hook members automatically to a flush position against the vertical posts when the angulation of said rigid shell member is changed relative to the vertical posts.

8. The wheelchair back system as defined in claim 1 wherein, said mounting units each are formed to receive said lower hooks and said mounting units each include a housing, said retaining arm, and said arm, being rotatably mounted to said housing, said pawl arm including a latching tip portion formed to extend from one side of said lower hooks completely over a top edge of said lower hooks to automatically capture and positively lock said lower hooks against unintentional release when said lower hooks are slid down into said mounting units.

9. The wheel chair back system as defined in claim 8 wherein, said mounting units include a cam coupled to interact with said retaining arm and said pawl arm upon rotation of said shell member in a forward direction to a certain predetermined position beyond said normal range of movement of said shell member during use of said wheelchair to cause said retaining arm and said pawl arm to separate from each other and thereby release said lower hooks from said mounting units.

10. A wheelchair back system for mounting to a pair of spaced apart vertical posts of a wheelchair back frame comprising:

a relatively rigid shell member;

a pair of upper hooks attached to said shell member proximate opposite sides of said shell member and adapted to be supported by the vertical posts of the wheelchair back frame, said upper hooks being fastened to an adjustment block assembly including a rotatable drive screw coupled to displace said adjustment block and attached upper hooks in forward and backward directions for adjustment of the angle of recline of said shell member relative to the vertical posts of the wheelchair back frame;

a pair of lower hooks attached to said shell member proximate opposite sides of said shell member and adapted to be supported by the vertical posts of the wheelchair back frame; and a pair of mounting units adapted to be mounted on the vertical posts and formed to receive and automatically releasably secure said lower hooks to said mounting units when said lower hooks are slid into said mounting units.

11. The wheelchair back system as defined in claim 10 wherein, said drive screw is accessible from behind said shell member and can be rotated while a user is seated in the wheelchair to which the back system is to be mounted.

12. A wheelchair back system for detachable mounting to a frame of a wheelchair comprising:

a wheelchair back assembly having a plurality of frame-engaging support surfaces; and a mounting unit having a pawl arm and a retaining arm each mounted for rotation relative to said mounting unit, said mounting unit being adapted for securement to said frame and formed to automatically releasably latch and positively lock one of said support surfaces of said back assembly to said mounting unit between said pawl arm and said retaining arm against unintentional release from said mounting unit during use of said wheelchair back system, said mounting unit and said support surfaces cooperating to support said back assembly, when mounted to said frame, in a stable substantially upright orientation proximate a seat mounted on said frame, and said mounting unit further being formed for automatic unlatching and release of said back assembly from said mounting unit by relative rotation of one of said pawl arm and said retaining arm away from the other of said pawl arm and retaining arm for detachment of said back assembly from said mounting unit after displacement of a portion of said back assembly relative to said mounting unit by an amount greater than is possible while a user is seated on said seat.

13. The wheelchair back system as defined in claim 12 wherein, said mounting unit is formed for automatic unlatching and release of said back assembly upon displacement of one of a top and a bottom of said back assembly in a forward direction over said seat by said amount.

14. The wheelchair back system as defined in claim 13 wherein, said back system includes a pair of mounting units each adapted for securement to said frame posts proximate said seat;

said support surfaces on said back assembly include a pair of hook members mounted to said back assembly proximate a bottom of said back assembly; and said mounting units are formed for automatic unlatching and release of said hook members upon rotation of a top portion of said back assembly in a forward direction over said seat about said pair of mounting units.

* * * * *